US007458808B2

(12) United States Patent
McCarren

(10) Patent No.: US 7,458,808 B2
(45) Date of Patent: Dec. 2, 2008

(54) GEL FUEL LOG SET

(75) Inventor: Gregory M. McCarren, Tryon, NC (US)

(73) Assignee: Woodlane Environmental Technology, Inc., Columbus, NC (US)

( * ) Notice: Subject to any disclaimer, the term of this patent is extended or adjusted under 35 U.S.C. 154(b) by 156 days.

(21) Appl. No.: 11/064,250

(22) Filed: Feb. 22, 2005

(65) Prior Publication Data

US 2006/0188832 A1 Aug. 24, 2006

(51) Int. Cl.
*F23Q 2/32* (2006.01)

(52) U.S. Cl. ..... 431/125; 431/150; 431/152; 431/331; 126/500

(58) Field of Classification Search ..... 431/125, 431/150, 152, 146, 331; 126/500, 512
See application file for complete search history.

(56) References Cited

U.S. PATENT DOCUMENTS

| | | | | |
|---|---|---|---|---|
| 3,759,674 | A | 9/1973 | Gregg | |
| 4,076,490 | A | 2/1978 | Hilker | |
| 4,496,379 | A * | 1/1985 | Kozawa | 96/130 |
| 4,573,905 | A | 3/1986 | Meyers | |
| 4,582,478 | A | 4/1986 | Hilker | |
| 4,637,372 | A | 1/1987 | Mogol et al. | |
| 4,838,781 | A | 6/1989 | Fischer | |
| 4,890,600 | A | 1/1990 | Meyers | |
| 5,026,271 | A | 6/1991 | Orlov et al. | |
| 5,435,295 | A | 7/1995 | Gerrard et al. | |
| 5,678,534 | A | 10/1997 | Fleming | |
| 5,794,610 | A | 8/1998 | Facchina | |
| 5,816,237 | A | 10/1998 | Fleming | |
| 6,123,066 | A | 9/2000 | Fleming | |
| 6,267,113 | B1 | 7/2001 | Maust et al. | |
| 6,269,809 | B1 | 8/2001 | Fleming | |
| 6,488,025 | B1 | 12/2002 | Cunningham | |
| 6,521,001 | B2 | 2/2003 | Mathew et al. | |
| 6,609,514 | B1 | 8/2003 | Bertolas | |
| 2002/0157306 | A1 | 10/2002 | Mathew et al. | |
| 2006/0037604 | A1 * | 2/2006 | Hoffmann et al. | 126/512 |

FOREIGN PATENT DOCUMENTS

| | | |
|---|---|---|
| DE | 203 04 139 U1 | 5/2003 |
| EP | 0 409 371 A1 | 1/1990 |
| EP | 0 409 371 B1 | 8/1992 |

OTHER PUBLICATIONS

"International Search Report mailed Oct. 27, 2006 in corresponding application PCT/US2006/006172, Publication No. WO/2006/091623".

* cited by examiner

*Primary Examiner*—Alfred Basichas
(74) *Attorney, Agent, or Firm*—Carter & Schnedler, P.A.

(57) ABSTRACT

An artificial log set including a fire grate having a base and an upper section pivotally connected to the base, pivotable between a lowered burning position and a raised access position. A fuel reservoir is supported by the base. A burner head is attached to the upper section so as to be positioned directly over the fuel reservoir when the upper section is in its lowered burning position, and so as to allow access to the fuel reservoir when the upper section is in its raised access position.

18 Claims, 10 Drawing Sheets

GEL FUEL LOG SET

BACKGROUND OF THE INVENTION

The invention relates generally to fireplace artificial log sets and, more particularly, to a fireplace artificial log set and a burner therefor which employs liquid or gelled-liquid fuel.

Fireplace artificial log sets are well known, and are commonly termed "gas logs," although other fuels have been employed. One example of a fuel other than gas is gelled alcohol fuel, similar or even identical to gelled alcohol fuel commonly sold in cans under the trademark STERNO® and intended for cooking or food-warming purposes. An advantage of a gel fuel log set compared to "gas logs" is that no installation is required (e.g. gas lines and/or propane tanks). A gel fuel artificial log set, including a grate, can be entirely portable, and is simply set inside any non-combustible fire chamber, such as a fireplace.

SUMMARY OF THE INVENTION

In one aspect, an artificial log set is provided which includes a fire grate having a base, as well as an upper section pivotally connected to the base. The upper section is pivotable between a lowered burning position and a raised access position. A fuel reservoir is supported by the base. A burner head having an interior volume including a flame zone is attached to the upper section so as to be positioned directly over the fuel reservoir and in communication with the fuel reservoir when the upper section is in its lowered burning position, and so as to allow access to the fuel reservoir when the upper section is in its raised access position.

In another aspect, an artificial log set is provided which includes a fire grate having a base, as well as an upper section pivotally connected to the base. The upper section is pivotable between a lowered burning position and a raised access position. A fuel reservoir is supported by the base. A burner head is attached to the upper section so as to be positioned directly over the fuel reservoir when the upper section is in its lowered burning position, and so as to allow access to the fuel reservoir when the upper section is in its raised access position. The burner head is rectangular in configuration and has a burner head interior volume in communication with the fuel reservoir when the upper section is in its lowered burning position. The burner head interior volume is defined by a pair of burner head end walls, a pair of opposed burner head main walls, and a burner head top. The burner head top has a pair of slotted openings, in particular, a combustion air intake slotted opening and a flame outlet slotted opening, separated by a top partial wall extending between the burner head end walls. The burner head includes an internal baffle extending horizontally between the burner head end walls and downwardly from the top partial wall towards the fuel reservoir. The internal baffle divides the interior volume into a combustion air zone in direct communication with the combustion air intake slotted opening, and a flame zone in direct communication with the flame outlet slotted opening.

In yet another aspect, a burner for liquid or gelled-liquid fuel is provided. The burner includes a fuel reservoir portion and a burner head portion over the fuel reservoir portion. At least the burner head portion is rectangular in configuration and has a burner head interior volume above and in communication with the fuel reservoir portion. The burner head interior volume is defined by a pair of burner head end walls, a pair of opposed burner head main walls, and a burner head top. The burner head top has a pair of slotted openings, in particular, a combustion air intake slotted opening and a flame outlet slotted opening, separated by a top partial wall extending between the burner head end walls. Within the burner head an internal baffle extends horizontally between the burner head end walls, and downwardly from the top partial wall towards the fuel reservoir portion. The internal baffle divides the interior volume into a combustion air zone in direct communication with the combustion air intake slotted opening, and a flame zone in direct communication with the flame outlet slotted opening.

DETAILED DESCRIPTION

Figure 1:
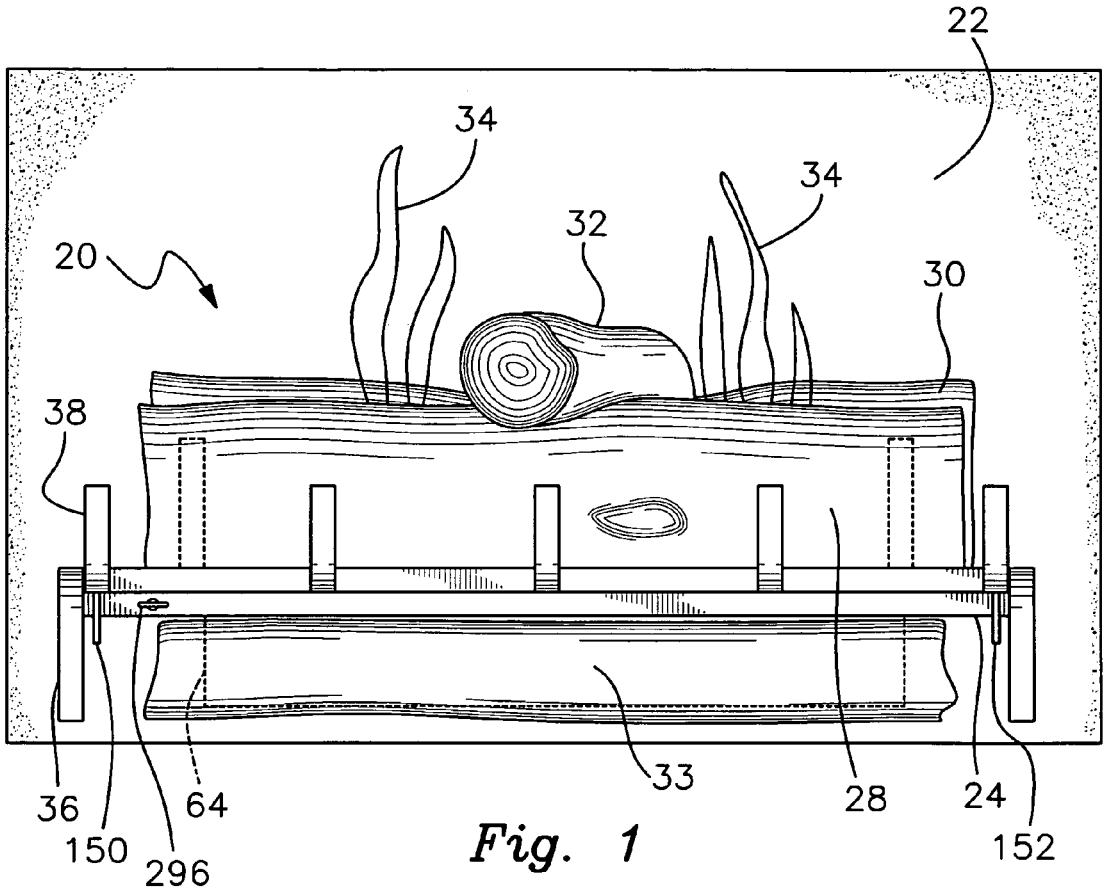
FIG. 1 is a front view of an artificial log set embodying the invention placed within a fireplace and in use.

Referring first to FIG. 1, an artificial log set 20 embodying the invention is shown in use within a conventional fireplace 22. The artificial log set 20 includes a fire grate 24 supporting a pair of primary artificial logs 28 and 30 which are attached to the fire grate 24 in predetermined positions, as well as upper and lower secondary artificial logs 32 and 33. The upper secondary artificial log 32 is positioned at the discretion of a user. The lower secondary artificial log 33 is positioned on the floor of the fireplace 22, generally below the fire grate 24. The artificial logs 28, 30, 32 and 33 are conventional in construction, and comprise, for example, a ceramic material, in the nature of a sculpture, suitably ornamented so as to have the appearance of natural logs. That the artificial log set 20 is in use is indicated by "dancing" flames 34.

Figure 2:
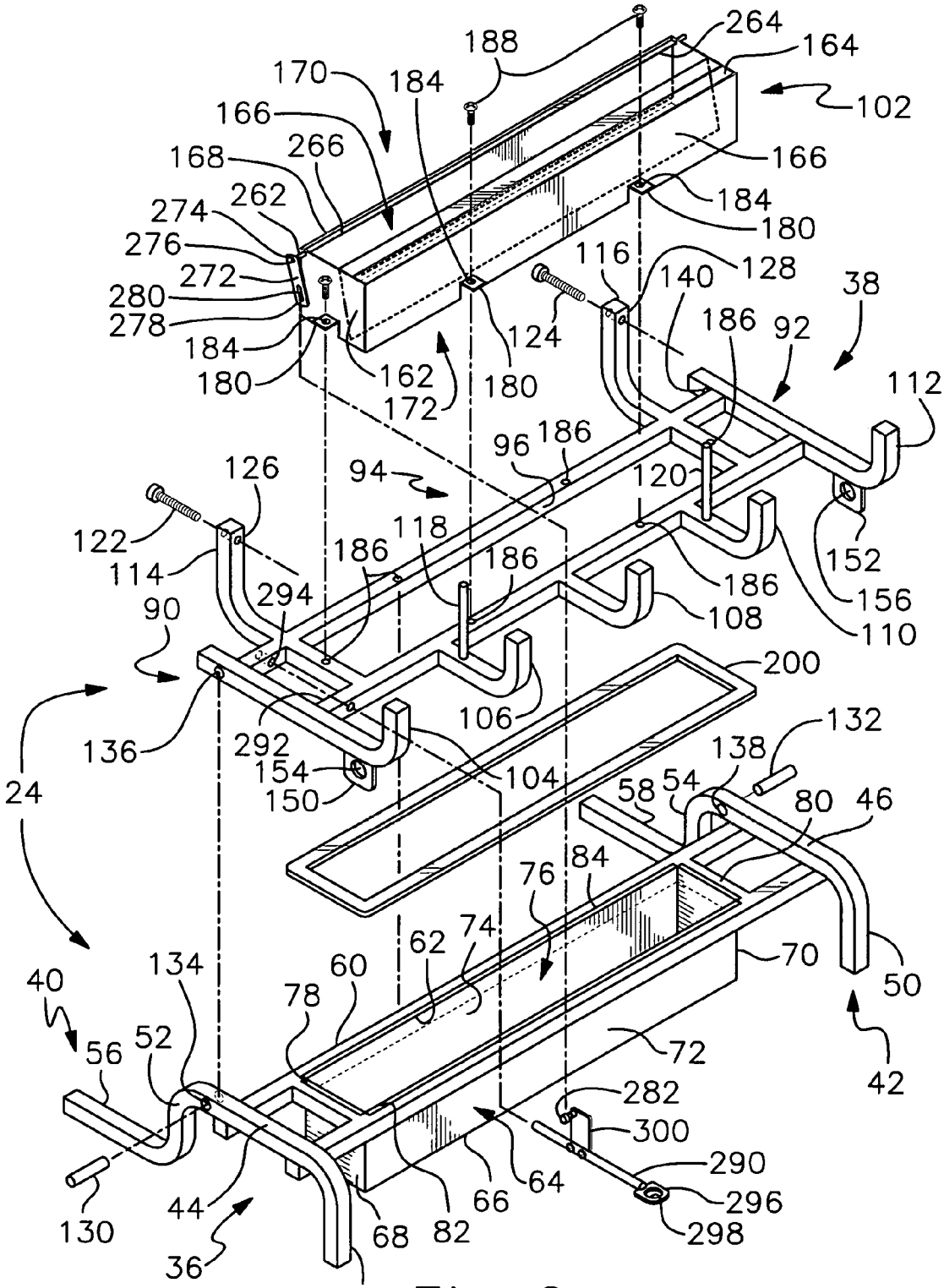
FIG. 2 is a three-dimensional exploded view of the log set of FIG. 1, but with the artificial logs omitted for clarity of illustration.
Figure 9:
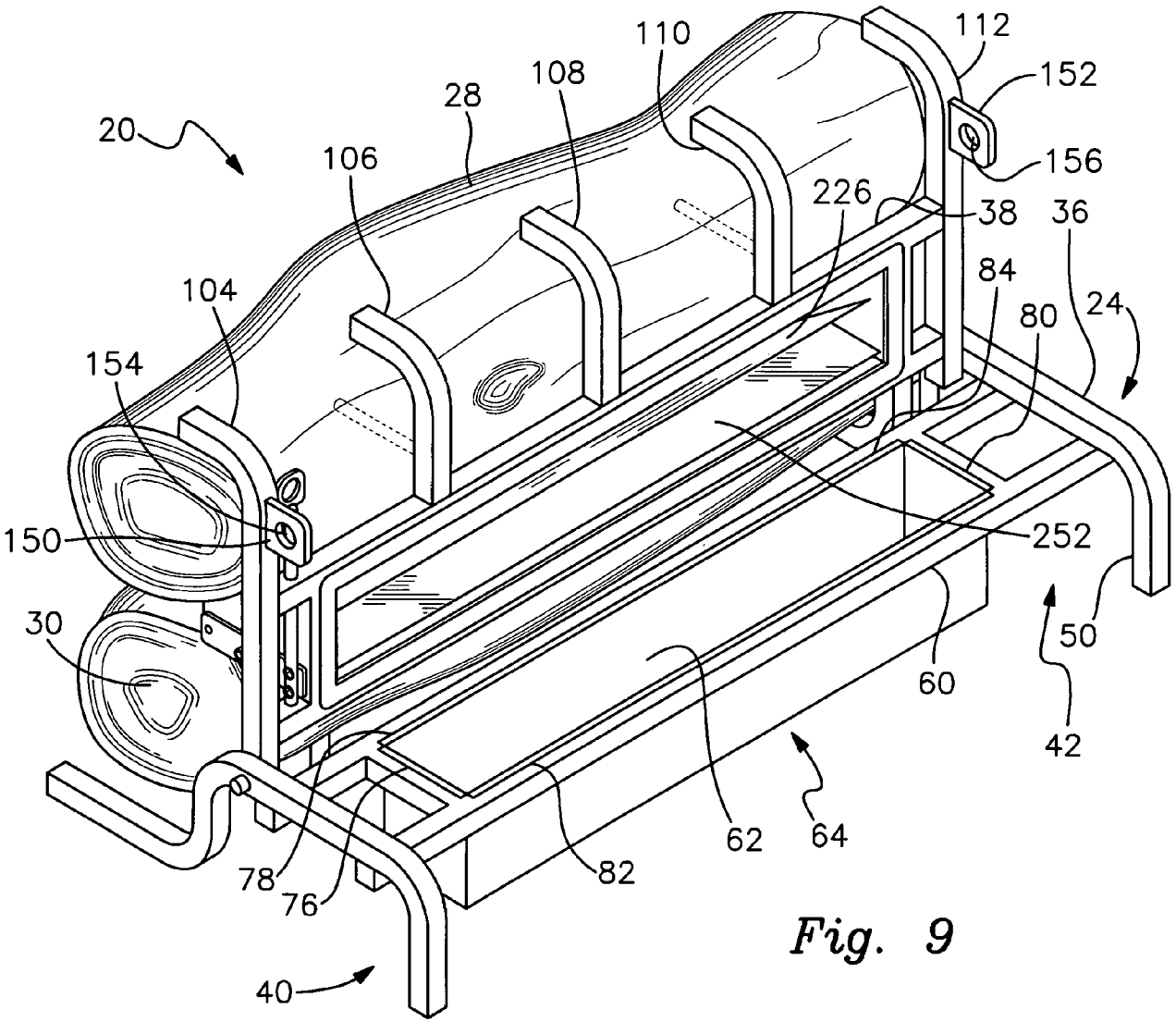
FIG. 9 is a three-dimensional view showing the artificial log set with the upper section pivoted to its raised access position, and with the interior of the fuel reservoir open and accessible.
Figure 10:
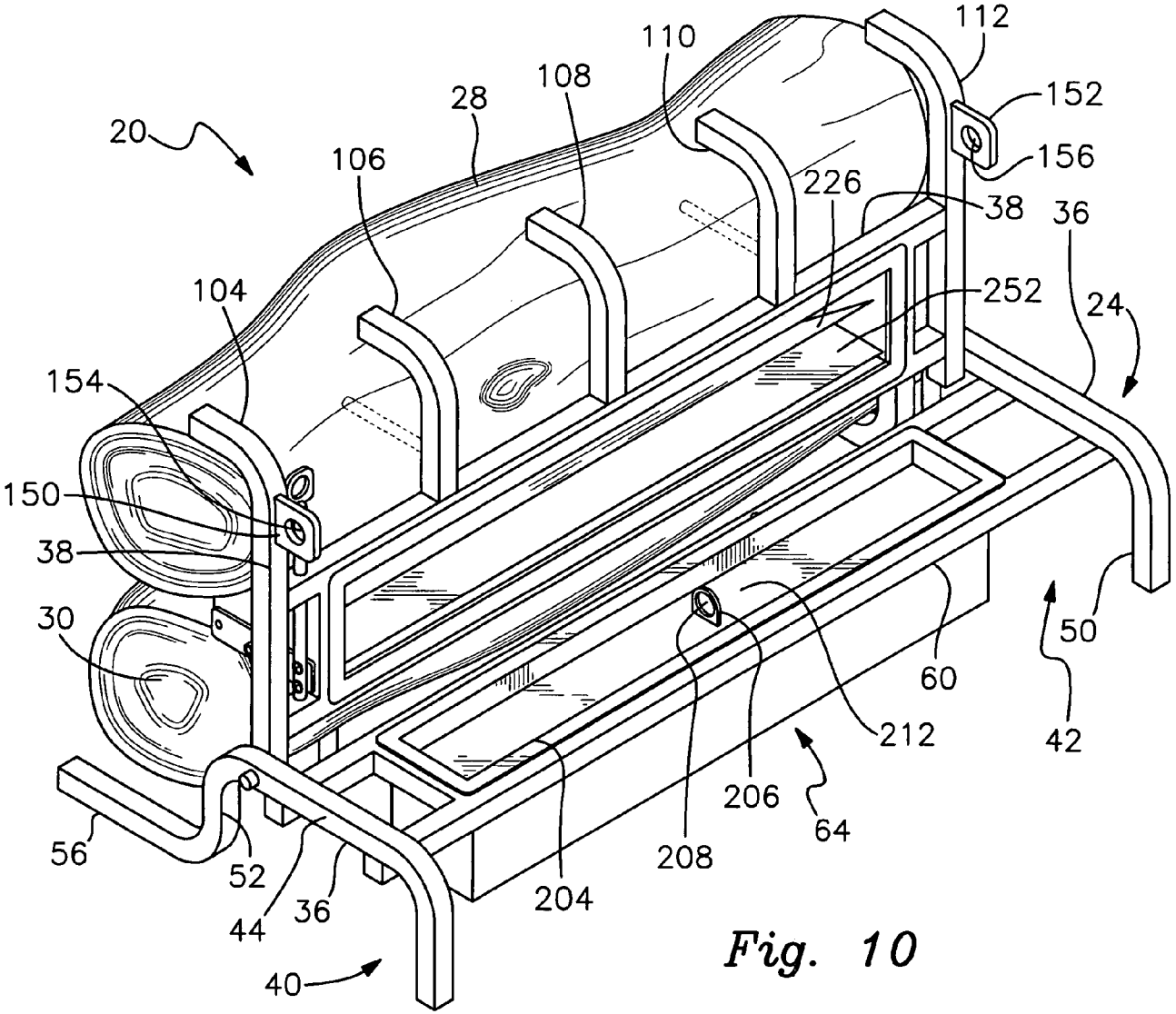
FIG. 10 is a view similar to FIG. 9, but with the FIG. 3 snuffer plate in position over the fuel reservoir.

Referring now to the exploded view of FIG. 2, as well as to FIGS. 5-9, the fire grate 24 includes a base 36 and an upper section 38, both fabricated from ½ inch hot rolled steel bar stock. The fire grate upper section 38 in general rests by gravity on the fire grate base 36 (FIGS. 5-8), and nests slightly inside the fire grate base 36, but is pivotably connected thereto so as to be pivotable between a lowered burning position (FIGS. 5-8) and a raised access or fueling position (FIGS. 9 and 10). The upper section 38 is stable in either its lowered burning position (FIGS. 5-8) or its raised access or fueling position (FIGS. 9 and 10).

The fire grate base 36 more particularly includes a pair of end pieces 40 and 42 having respective horizontal segments 44 and 46, front legs 48 and 50, and rear legs 52 and 54. Rearwardly-extending horizontal extensions 56 and 58 on the rear legs 52 and 54 serve a stabilizing function when the fire grate 24 upper section 38 is pivoted upwardly and rearwardly to its raised access position (FIGS. 9 and 10). A frame 60 extends between the end pieces 40 and 42, below the horizontal segments 44 and 46. The frame 60 has an opening 62 which receives a fuel tray 64.

The fuel tray 64 is rectangular in configuration, and includes a solid bottom 66, a pair of end walls 68 and 70, and a pair of fuel tray main walls 72 and 74. The fuel tray 64 has an open top 76, and a set of four outwardly-extending flanges 78, 80, 82 and 84 in the form of extensions of the walls 68, 70, 72 and 74, bent at a right angle. When installed, the fuel tray 84 is positioned within the frame 60 opening 62, and suspended by the flanges 78, 80, 82 and 84. The fuel tray 64 is fabricated of sheet metal, such as 22 gauge cold rolled steel.

The fire grate 24 upper section 38 has a pair of end pieces 90 and 92, and a frame 94 extending between the end pieces 90 and 92. The upper section 38 is sized so that the upper section 38 end pieces 90 and 92 fit just inside the horizontal segments 44 and 46 of the base 36 end pieces 40 and 42 in generally the same horizontal plane, and rest on the frame 60 of the base 36.

The frame 94 of the upper section 38 has an opening 96, which is similar in size to the fuel tray 64 opening 62 of the fire grate base 36. The opening 96 receives a lower portion 98 of a burner head 102.

Attached to the end pieces 90 and 92 and frame 94 of the upper section 38 is a set of five front log supports 104, 106, 108, 110 and 112, which curve upwardly. The front log supports 104 and 112 are extensions of the end pieces 90 and 92, respectively. A pair of rear log supports 114 and 116 are attached to the rear of the frame 94.

A pair of front log-positioning posts 118 and 120 extend upwardly from the fire grate 24 upper section 38, and are positioned so as to engage bores extending upwardly into the primary artificial log 28 from the bottom thereof. Machine screws 122 and 124 when screwed all the way in and through threaded apertures 126 and 128 in the rear log supports 114 and 116 so that the machine screws 122 and 124 project forwardly from the supports 114 and 116 serve a similar function and engage bores extending horizontally into the primary artificial log 30 from the rear thereof. The primary artificial logs 28 and 30 thus effectively remain attached to the fire grate 24 upper section 38 whether the upper section 38 is in its lowered burning position (FIGS. 5, 7 and 8) or its raised access position (FIGS. 9 and 10).

The fire grate 24 upper section 38 and base 36 are connected by hinge pins 130 and 132, which engage aligned apertures 134 and 136 towards the rear of the end pieces 40 and 90 on the left side of the fire grate 24, and aligned apertures 138 and 140 towards the rear of the end pieces 42 and 92 on the right side of the fire grate 24. The geometry is such that the upper section 38 pivots upwardly and rearwardly through an arc of about 93° from its lowered burning position (FIGS. 5, 7 and 8), where the upper section 38 is horizontal and parallel to the fireplace 22 floor, to its raised access position (FIGS. 9 and 10), where the upper section 38 is tilted back and approximately perpendicular to the fireplace 22 floor. The center of gravity of the upper section 38, with the burner head 102 and primary artificial logs 28 and 30 attached, is behind a pivot axis defined by the hinge pins 130 and 132 and apertures 134, 136, 138 and 140 so that the upper section 38 is stable in its raised access position. No latches or detents are required. The upper section 38 in its tilted-back, raised access position is supported by engagement of the rearward projecting portion of upper grate section 38 with the horizontal frame 60 of the lower grate section 36.

Figure 4:
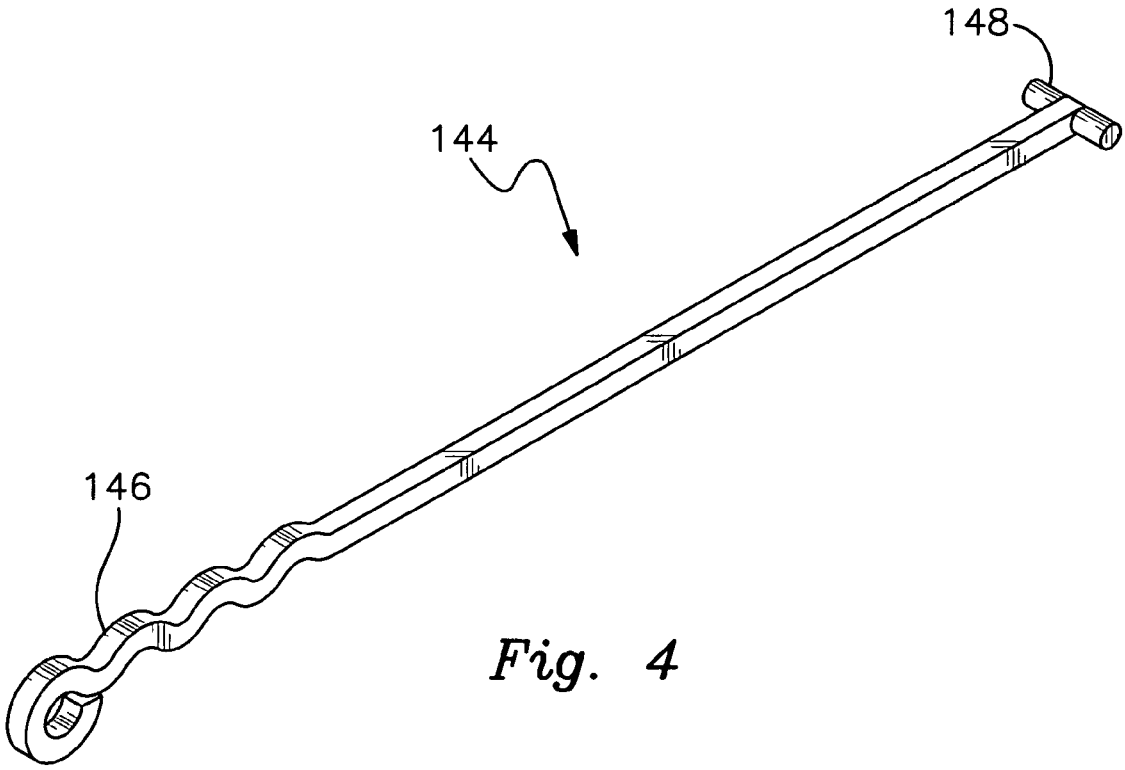
FIG. 4 depicts a tool which may be employed for manipulating the snuffer plate of FIG. 3, for pivoting the upper section of the artificial log set, and for adjusting flame height.

To facilitate raising and tilting back of the upper section 38 by a user, a tool 144 (FIG. 4) having a handle 146 and an engagement end 148 is provided. (The tool 144 has additional functions, described hereinbelow.) Two tabs 150 and 152 are secured near the front of the upper section 38, in particular to the front log supports 104 and 112 at the ends of the upper section 38. The tabs 150 and 152 have corresponding apertures 154 and 156 sized so as to receive the engagement end 148 of the tool 144.

The burner head 102 is rectangular in configuration, and has an interior volume 160 defined by a pair of burner head end walls 162 and 164, a pair of opposed burner head main walls 166 and 168, and a burner head top 170. The burner head 102 has an open bottom 172 so that the interior volume 160 is in communication with the fuel reservoir 64 when the upper section 38 is in its lowered burning position (FIGS. 5-8). In the burning position, the burner head 102 and the fuel reservoir 64 together define a burner 174 for liquid or gelled-liquid fuel 176 contained within the fuel reservoir 66. Accordingly, the burner head 102 may also be referred to as the burner head portion 102 of the burner 174, and the fuel reservoir 64 may also be referred to as the fuel reservoir portion 64 of the burner 174. The burner head 102 is fabricated of sheet metal, such as 24 gauge type 304 stainless steel.

For securing the burner head 102 to the frame 94 of the upper section 38, securing tabs 180 are formed out of the burner head walls 162, 164, 166 and 168 adjacent the bottom 172 of the burner head 104. The tabs 180 are configured so that when the tabs 180 are resting on the upper portion of the frame 94 around the opening 96, the lower portion 98 of the burner head 102 is within the opening 96, and the bottom 172 of the burner head 104 is generally even with the bottom 182 (FIG. 6) of the upper section 38. The securing tabs 180 have apertures 184 which align with apertures 186 or threaded apertures 186 in the frame 94. The burner head 102 is secured to the frame 94 by threaded fasteners 188 which engage aligned apertures 184 and 186. Threaded fasteners 188 are shown, but rivets may as well be employed.

Figure 6:
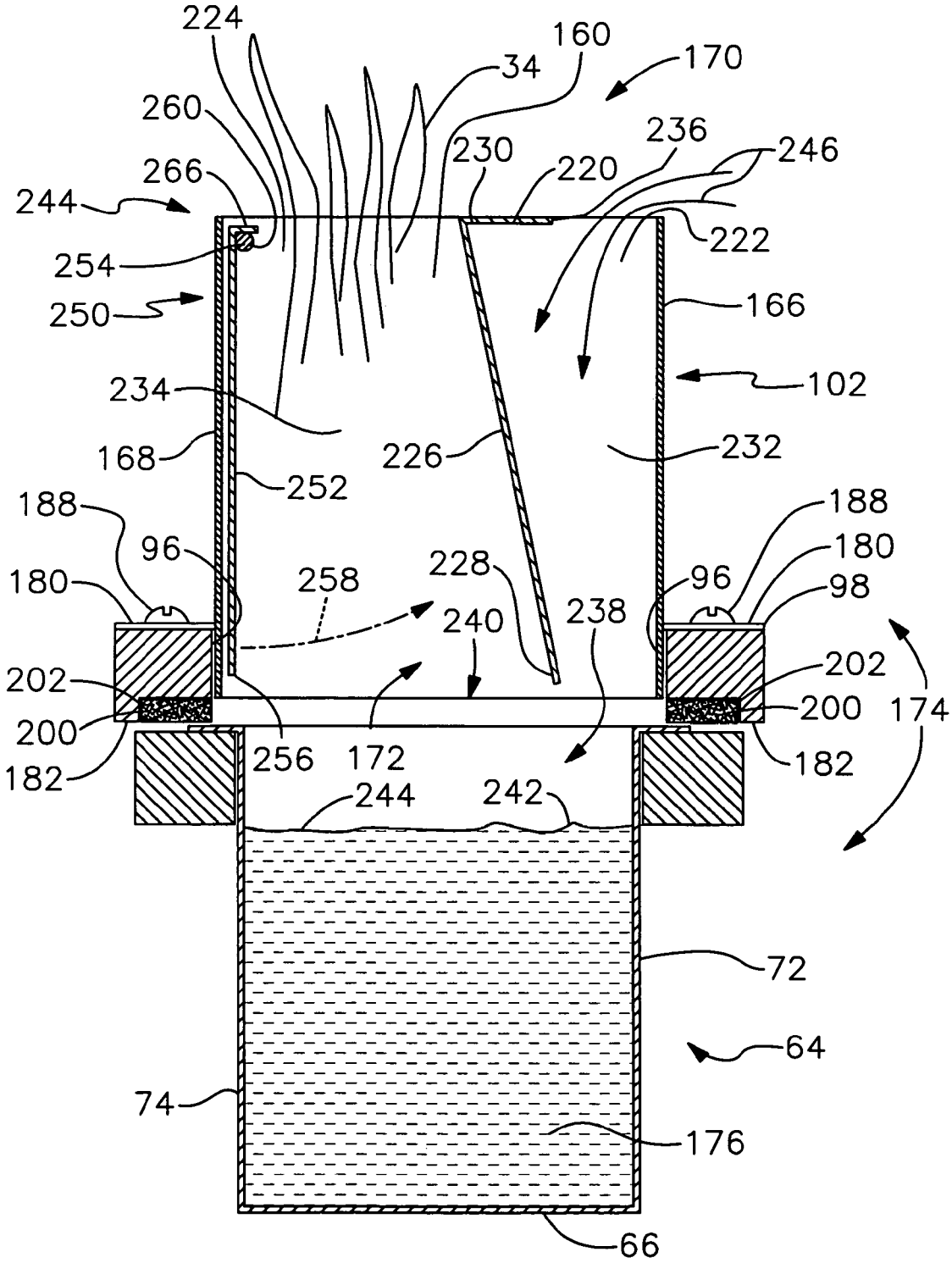
FIG. 6 is a cross-sectional view taken generally on line 6-6 of FIG. 5, depicting the burner head in use.

In order to provide a substantially air-tight seal between the fuel reservoir 76 and the interior volume 160 of the burner head 102, a gasket 200 is provided, and received within a recess 202 within the underside of the frame 94. This sealing engagement is best seen in FIG. 6. Thus, the burner head 102 and fuel reservoir 64 are similar in rectangular configuration. In the illustrated embodiment, the rectangular opening 96 in the upper section 38 for the burner head 102 is ¼ inch larger front-to-back (best seen in FIG. 6), than the rectangular opening 62 in the base 36 for the fuel reservoir 64. This allows for better contact with the gasket 200, and better accommodates a snuffer plate 204 when it is left in the log set 20 in the lowered position. The rectangular opening 62 in the base 36 is slightly wider in its long dimension, by approximately ⅛ inch to accommodate variations in the manufacture of the fuel reservoir 64.

In the exemplary embodiment, the burner head 102 and fuel reservoir 64 are elongated, with the burner head 102 main walls 166 and 168 and the fuel reservoir main walls 72 and 74 having a greater lateral extent than the burner head 102 end walls 162 and 164 and the fuel reservoir 64 end walls 68 and 70. The main walls 72, 74, 166 and 168 are approximately thirteen inches in length (extending left to right), and are each approximately two and one-half inches high. The end walls 68, 70, 162 and 164 likewise are approximately two and one-half inches in height, and approximately two inches wide.

Figure 3:
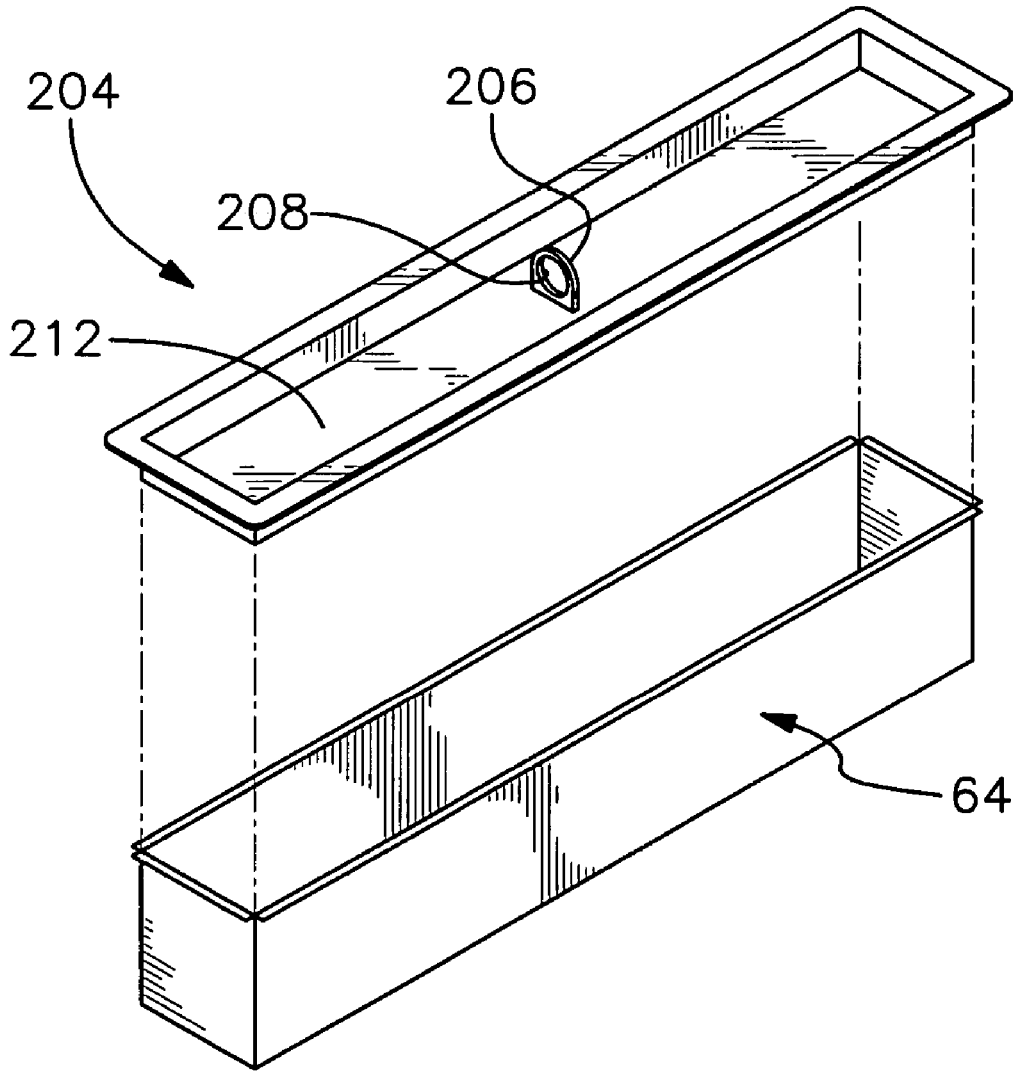
FIG. 3 is a three-dimensional view of a separate and removable snuffer plate which may selectively be employed to cover the lower, fuel reservoir portion of the log set, also shown in FIG. 3.

With particular reference to FIGS. 3 and 10, a snuffer plate 204 is provided which fits over the fuel reservoir 64, and can selectively be placed in position over the fuel reservoir 64 as illustrated in FIG. 10 when it is desired to snuff out a fire, or to minimize evaporation of fuel 176 within the reservoir 64. To facilitate manipulation of the snuffer plate 204 employing the tool 144 (FIG. 4), the snuffer plate 204 has an upwardly-extending centrally located tab 206 with an aperture 208 for receiving the engagement end 148 of the tool 144. Sufficient clearance is provided so that the snuffer plate 204 can remain in position over the fuel reservoir 64 even when the upper section 38 is in its lowered burning position. The snuffer plate 204 has a recess 212, formed such as by drawing, within which the tab 206 is secured and which avoids interference between the tab 206 and the burner head 102.

Figure 5:
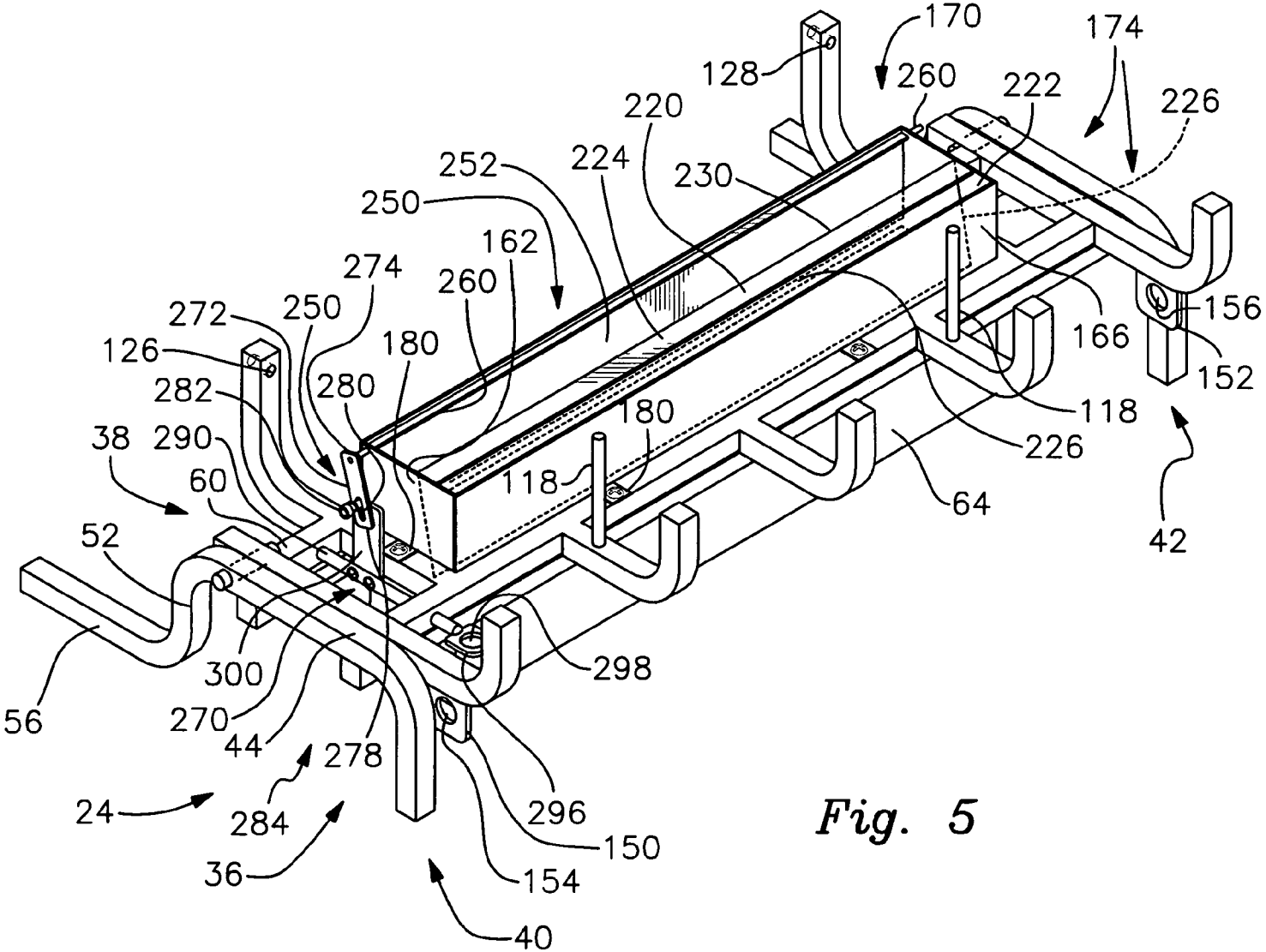
FIG. 5 is a three-dimensional view depicting the components of FIG. 2 in their assembled position, again, with the artificial logs omitted for clarity of illustration, with a flame height control damper in its open position.
Figure 7:
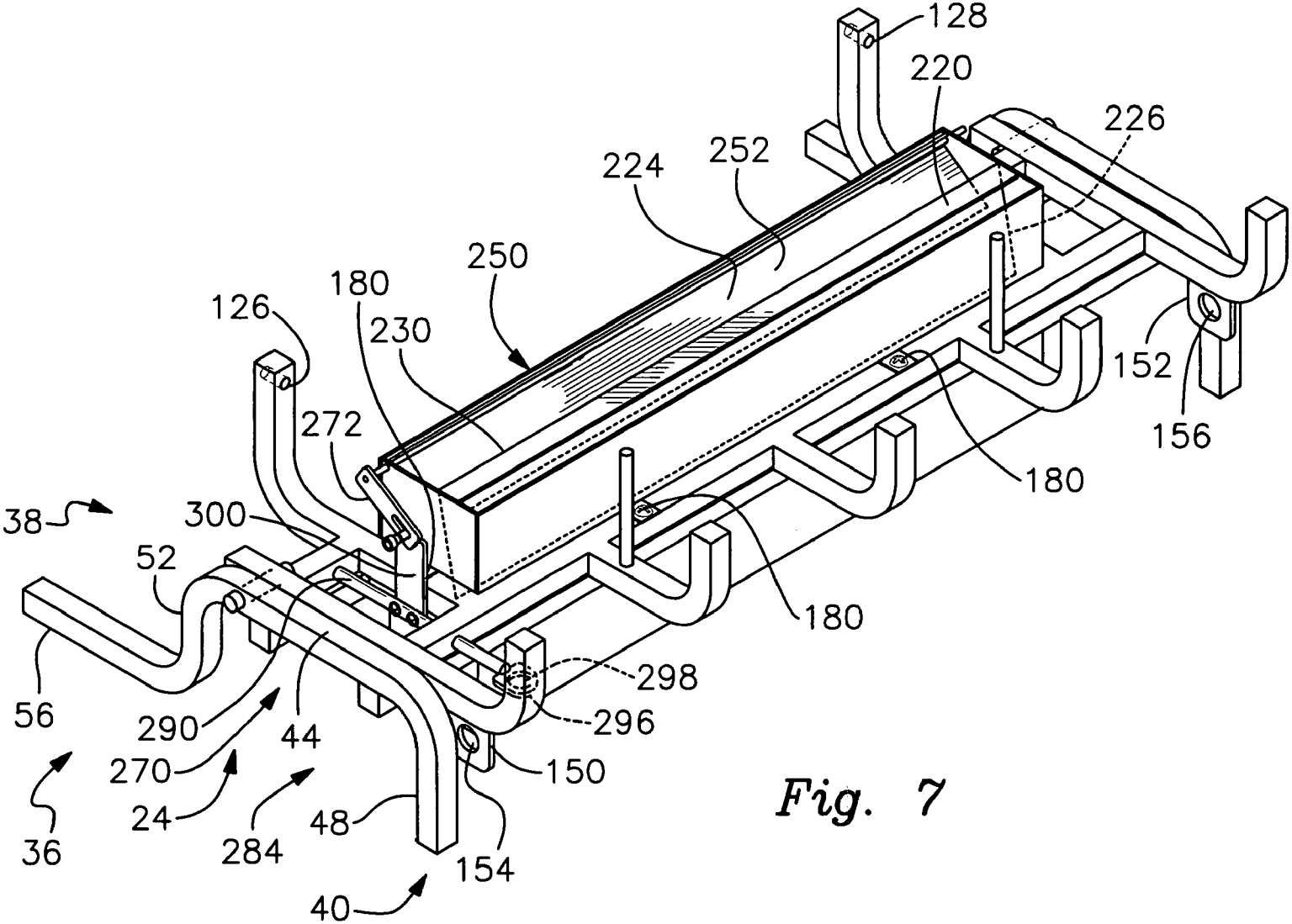
FIG. 7 is a three-dimensional view similar to FIG. 5, but with the flame height damper in its closed position.
Figure 8:
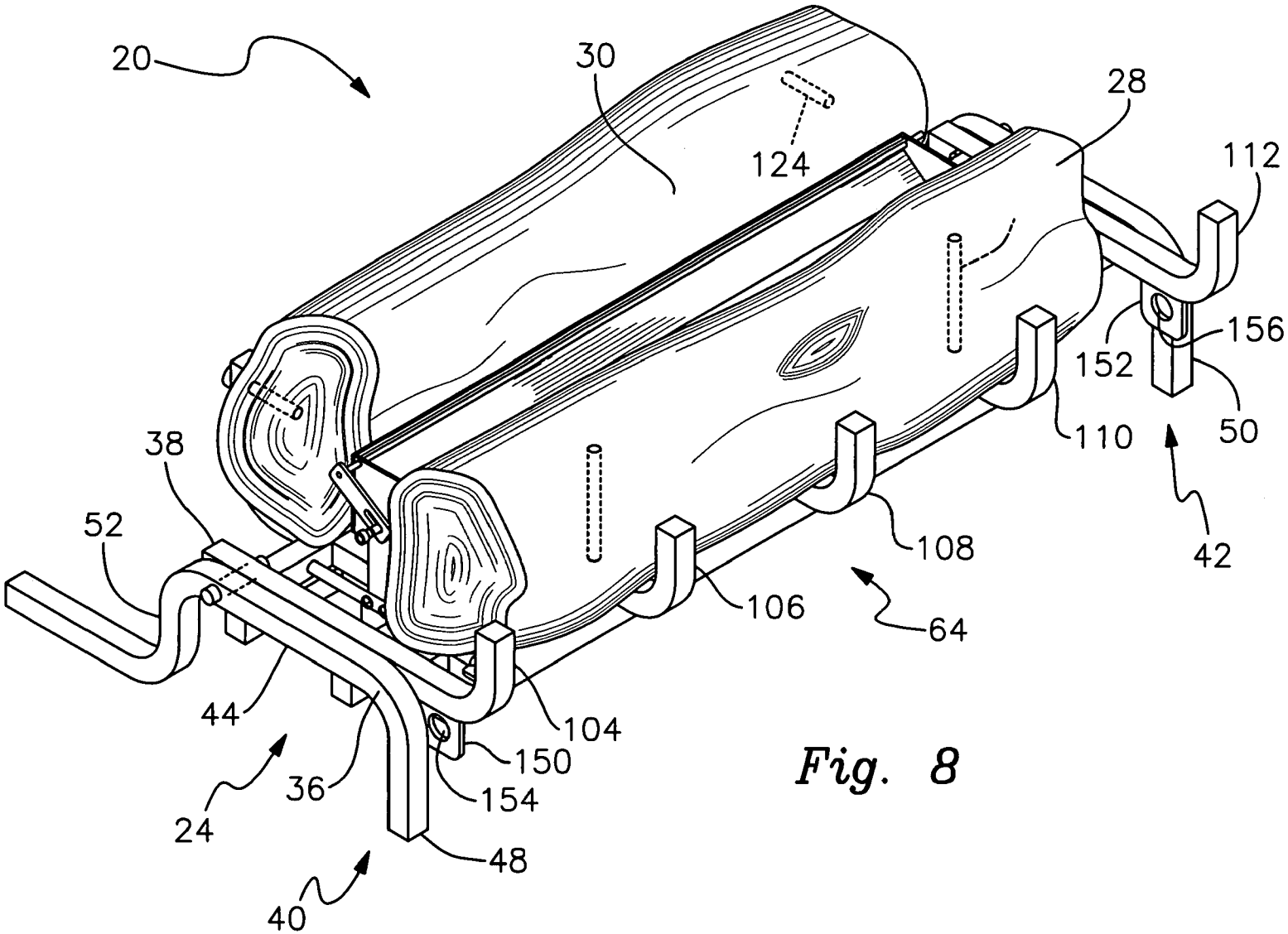
FIG. 8 is a three-dimensional view comparable to FIG. 5, but with the artificial logs in position.

With particular reference to FIGS. 5-7, the top 170 of the burner head 102 more particularly takes the form of a top partial wall 220 extending between the end walls 162 and 164 of the burner head 102, separating and at least in part defining a pair of slotted openings, in particular, a combustion air intake slotted opening 222 and a flame outlet slotted opening 224. An internal baffle 226 extends within the burner head 102 between the end walls 162 and 164 downwardly from the top partial wall 220 towards to the fuel reservoir 66, terminating in a lower edge 228. As a matter of construction, the internal baffle 226 is formed integrally with the top partial wall 220, joined at a bend line 230, and the angle between the two provides structural rigidity. The top partial wall 220 and baffle 226 are fabricated of sheet metal, such as 20 gauge type 304 stainless steel. The internal baffle 226 divides the interior volume 160 of the burner head 102 into a combustion air zone 232 which is in direct communication with the combustion air intake slotted opening 222, and a flame zone 234 which is in direct communication with the flame outlet slotted opening 224.

The combustion air intake slotted opening 222 is immediately adjacent the burner head 102 main wall 166 towards the front of the artificial log set 20, and the top partial wall 220 has a forwardly-facing edge 236 adjacent the combustion air intake slotted opening 222. The flame outlet slotted opening 224 is immediately adjacent the burner head 102 main wall 168 towards the rear of the artificial log set 20. The bend line 230 defines a rearwardly-facing edge 230 of the top partial wall 220, adjacent the flame outlet slotted opening 224.

The lower edge 228 of the baffle 226 is located so as to expose a first region 238 of the fuel reservoir 64 primarily to the combustion air zone 232, and a second region 240 of the fuel reservoir 64 primarily to the flame zone 234. Corresponding areas 242 and 244 of the surface of the actual fuel 176 are exposed primarily to the combustion air zone 232 and primarily to the flame zone 234.

With proper proportioning of the various elements of the burner 174, and particularly within the burner head portion 102, a realistic flame is provided, which "dances" about in a pleasing manner. Thus, the position of the flames 34 in FIG. 1 is an instantaneous position; a moment later the flames 34 are in a different position.

As examples of proportions which have been determined to provide desirable burning and flame conditions, the flame outlet slotted opening 224 is larger in area than the combustion air intake slotted opening 222. Preferably, and as is best seen in FIG. 6, the ratio of the area of the flame outlet slotted opening 224 to the area of the combustion air intake slotted opening 222 is within the range 1.5:1 to 3:1, inclusive. In the exemplary embodiment, the ratio of the area of the flame outlet slotted opening 224 to the area of the combustion air intake slotted opening 222 is approximately 2:1. If the two slotted openings are too similar in area, the flame 34 is just as likely to come out through the intended combustion air intake slotted opening 222, instead of through the flame outlet slotted opening 224. Dimensionally, in the illustrated embodiment, the combustion air intake slotted opening 222 is approximately one-half inch in width, the flame outlet slotted opening 224 is approximately one inch in width, and the width of the top partial wall 220 is approximately one-half inch in width.

The internal baffle 226 limits the first region 238 of the fuel reservoir and thus the surface area 242 of the fuel 176 exposed to the combustion air zone 232 and to the combustion air intake slotted opening 222, while maximizing the second region 240 of the fuel reservoir 64 and thus the surface area 244 of the fuel 176 exposed to the flame zone 234 and to the flame outlet slotted opening 224. This has the effect of encouraging the flames 34 to escape through the flame outlet slotted opening 224, which pulls combustion air in through the combustion air intake slotted opening 222, as represented by arrows 246.

The positioning of the internal baffle 226, and particularly the lower edge 228 thereof, more particularly is such that the ratio of the area of the second region 240 of the fuel reservoir 64 exposed to the flame zone 234 (and thus the surface area 244 of the fuel 176 exposed to the flame outlet slotted opening 224) to the area of the first region 238 of the fuel reservoir 64 exposed to the combustion air zone 232 (and thus the surface area 242 of the fuel 176 exposed to the combustion air intake slotted opening 222) is approximately 3:1.

The internal baffle 226 extends downwardly from the edge 230 of the top partial wall 220 (being integral therewith) adjacent the flame outlet slotted opening 224. The internal baffle 226 forms an acute angle with the top partial wall 220 such that the ratio of the area of the second region 240 of the fuel reservoir 64 which is exposed to the flame zone 234 to the area of the first region 238 of the fuel reservoir 64 which is exposed to the combustion air zone 232 is greater than would be the case if the internal baffle 226 extended vertically downwardly at an angle of 90° with reference to the top partial wall 220. In the exemplary embodiment, the lower edge 228 of the internal baffle 226 is approximately directly below the forwardly-facing edge 236 of the top partial wall 220 which is adjacent the combustion air intake slotted opening 222.

After combustion is initiated and the burner 174 warms up, fuel is volatilized particularly above the surface 244, and enters the flame zone 234, mixed with air drawn in through the combustion air intake slotted opening 222. So that a pleasing yellow and not a blue flame is produced, an oxygen-starved combustion environment is established. The base of the flames 34 occurs somewhere within the flame zone 234, and flames 34 emerge from the flame outlet slotted opening 224.

For flame height adjustment, an adjustable damper generally designated 250 is provided, and functions to selectively reduce the effective size of the flame outlet slotted opening 224. It will be appreciated that more precise control can be achieved by providing a second adjustable damper (not shown) operationally linked to the adjustable damper 250 by a suitable linkage (not shown) so as to simultaneously selectively reduce the effective size of the combustion air intake slotted opening 222 and thereby better maintain the ratio of the area of the flame outlet slotted opening 224 to the area of the combustion air intake slotted opening 222. However, as a practical matter, in a commercial embodiment, it is sufficient to provide the single adjustable damper 250 for selectively reducing the effective size of the flame outlet slotted opening 224. Such a simplified structure minimizes potential problems with adjustment and binding as thermal expansion and contraction of the various component parts occur.

The adjustable damper 250 more particularly takes the form of a plate 252 pivotably connected to the burner head 102 main wall 168 which is towards the rear of the log set 20, immediately adjacent the flame outlet slotted opening 224 opposite the internal baffle 226. As shown in FIG. 6, the damper plate 252 has an upper pivot axis 254 and a lower edge 256 which selectively swings as indicated by arrow 258 towards the internal baffle 226.

In the particular construction illustrated, a pivot pin 260 extends the length of the burner head 102, and engages pivot apertures 262 and 264 in the end walls 162 and 164. The damper plate 252 at its upper edge 266 is bent at a 90° angle to form a flange, and welded to the pivot pin 260. Thus, the position of the damper plate 252 is controlled by rotating the pivot pin 260. The pivot pin 260 is ⅛ inch in diameter, and made of hardened steel. The damper plate 252 is fabricated from sheet metal, such as 20 gauge type 304 stainless steel.

To facilitate adjustment of the damper 250, a linkage generally designated 270 is provided. The linkage 270 includes a lever arm 272 secured near its upper end 274 to an end 276 of the pivot pin 260, just outside the burner head 102 end wall 162, where the pivot pin passes through the pivot aperture 262. Adjacent the lower end 278 of the lever arm 272 is a slotted aperture 280 which is engaged by a shoulder screw 282 carried by an actuator generally designated 284.

The actuator 284 more particularly includes a sliding actuator shaft 290 which slidably engages a pair of bearing apertures 292 and 294 in the frame 60 of the upper section 38 of the fire grate 24. At one end of the sliding actuator shaft 290 there is a tab 296 with an aperture 298 which can be engaged by the engagement end 248 of the tool 144 for user adjustment of the damper 250. Fixedly attached to the sliding actuator shaft 290, such as by screws, is an upwardly-extending piece 300 which receives the shoulder screw 282.

Operation of the damper 250 is represented in FIGS. 5 and 7. Employing the tool 144 the actuator shaft 290 can be pushed all the way in as is illustrated in FIG. 5 to fully open the damper 250 for maximum flame height, and all the way out as illustrated in FIG. 7 to completely close the damper 250.

To use the log set 20, the upper fire grate section 38 is tilted to the raised access position (FIG. 9), exposing the fire grate base 36 and the top 76 of the fuel reservoir 64. The tool 144 may be employed for this purpose, engaging the aperture in the tab 150, or the aperture 156 in the tab 152. If present, the snuffer plate 204 is removed from over the fuel reservoir 64 (FIG. 10), again employing the tool 144. Gelled-liquid fuel is squeezed into the fuel reservoir 64 from a plastic bottle (not shown). The user may elect at this time to light the exposed fuel 176 in the reservoir 64. Alternatively, the fuel 176 can be lit with a long match after the upper grate section 38 has been repositioned to the lowered burning position. In either event, the upper grate section 38 is lowered to the burning position (FIG. 8), and the gasket 200 forms a seal between the frame 94 surrounding the lower portion 98 of the burner head 102 and the fuel reservoir flanges 78, 80, 82 and 84. The flame height is adjusted if desired, again using the tool 144, by engaging the aperture 298 in the tab 296 to move the actuator shaft 290 in and out. Through the linkage 270, the damper plate 252 in the burner head 102 correspondingly moves (FIGS. 5 and 7).

When the user wishes to extinguish the fire, the upper grate section 38 is again tilted up employing the tool 144 to expose the burning fuel reservoir 64. The snuffer plate 204 is put into and over the fuel reservoir 64 using the tool 144. The snuffer plate 204 can be left in position when the upper grate section 38 is returned to the lowered position, helping to preserve any remaining fuel 176 by sealing it from air and evaporation.

The artificial log set 20 is intended to be used with a gelled-liquid fuel such as gelled-alcohol fuel formulated so as to be pourable, and yet resistant to spreading out over a large area in the event of a spill. However, liquid alcohol may also be employed as fuel for the burner 174. Burn times before refueling is required range from one hour to four hours, depending on the adjustment of the damper 150, and the particular formulation of the fuel 176. Flames 34 approximately eight to twelve inches high are obtained.

While a particular embodiment of the invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An artificial log set comprising:

a fire grate including a base and an upper section pivotally connected to said base, said upper section pivotable between a lowered burning position and a raised access position;

a fuel reservoir supported by said base;

a burner head attached to said upper section so as to be positioned directly over said fuel reservoir when said upper section is in its lowered burning position, and so as to allow access to said fuel reservoir when said upper section is in its raised access position;

said burner head being rectangular in configuration and having a burner head interior volume in communication with said fuel reservoir when said upper section is in its lowered burning position, said burner head interior volume being defined by a pair of burner head end walls, a pair of opposed burner head main walls, and a burner head top;

said burner head top having a combustion air intake slotted opening and a flame outlet slotted opening separated by a top partial wall extending between said burner head end walls; and said burner head including an internal baffle extending horizontally between said burner head end walls and downwardly from said top partial wall towards said fuel reservoir, said internal baffle dividing said interior volume into a combustion air zone in direct communication with said combustion air intake slotted opening and a flame zone in direct communication with said flame outlet slotted opening.

2. The artificial log set of claim 1, wherein said internal baffle has a lower edge located so as to expose a first region of said fuel reservoir portion primarily to the combustion air zone and a second region of said fuel reservoir portion primarily to the flame zone, the second region being greater in area than the first region.

3. A burner for liquid or gelled-liquid fuel, comprising:

a fuel reservoir portion and a burner head portion over said fuel reservoir portion;

at least said burner head portion being rectangular in configuration, and having a burner head interior volume above and in communication with said fuel reservoir portion, said burner head interior volume being defined by a pair of burner head end walls, a pair of opposed burner head main walls, and a burner head top;

said burner head top having a combustion air intake slotted opening and a flame outlet slotted opening separated by a top partial wall extending between said burner head end walls; and an internal baffle within said burner head extending horizontally between said burner head end walls and downwardly from said top partial wall towards said fuel reservoir portion, said internal baffle dividing said interior volume into a combustion air zone in direct communication with said combustion air intake slotted opening and a flame zone in direct communication with said flame outlet slotted opening.

4. The burner of claim 3, wherein said burner head portion is elongated, with said burner head main walls having a greater lateral extent than said burner head end walls.

5. The burner of claim 3, wherein said combustion air intake slotted opening is immediately adjacent one of said burner head main walls and said flame outlet slotted opening is immediately adjacent the other of said burner head main walls.

6. The burner of claim 5, wherein said slotted openings extend between said burner head end walls.

7. The burner of claim 3, wherein said flame air outlet slotted opening is larger in area than said combustion air intake slotted opening.

8. The burner of claim 7, wherein the ratio of the area of said flame outlet slotted opening to the area of said combustion air intake slotted opening is within the range 1.5:1 to 3:1, inclusive.

9. The burner of claim 8, wherein the ratio of the area of said flame outlet slotted opening to the area of said combustion air intake slotted opening is approximately 2:1.

10. The burner of claim 3, wherein said internal baffle has a lower edge located so as to expose a first region of said fuel reservoir portion primarily to the combustion air zone and a second region of said fuel reservoir portion primarily to the flame zone, the second region being greater in area than the first region.

11. The burner of claim 10, wherein the ratio of the area of the second region to the area of the first region is approximately 3:1.

12. The burner of claim 10, wherein said internal baffle extends downwardly from an edge of said top partial wall adjacent said flame outlet slotted opening.

13. The burner of claim 12, wherein said internal baffle forms an acute angle with said top partial wall such that the ratio of the area of the second region to the area of the first region is greater than would be the case if the internal baffle extended vertically downwardly at an angle of 90° with reference to said top partial wall.

14. The burner of claim 3, which further comprises an adjustable damper for selectively reducing the effective size of said flame outlet slotted opening for flame height adjustment.

15. The burner of claim 13, which further comprises an adjustable damper for selectively reducing the effective size of said flame outlet slotted opening in cooperation with said internal baffle for flame height adjustment, said adjustable damper in turn comprising a plate pivotally connected to one of said burner head main walls adjacent said flame outlet slotted opening opposite said internal baffle.

16. The burner of claim 15, which further comprises a linkage connected to said damper to facilitate adjustment.

17. The burner of claim 3, wherein said burner head portion is separable from said fuel reservoir portion so as to provide access to said fuel reservoir portion.

18. The burner of claim 17, which further comprises a removable snuffer plate configured to cover said fuel reservoir portion for snuffing a fire.

* * * * *